US005501278A

United States Patent [19]

Garrett et al.

[11] Patent Number: 5,501,278

[45] Date of Patent: Mar. 26, 1996

[54] METHOD OF ACHIEVING HIGH PRODUCTION RATES IN WELLS WITH SMALL DIAMETER TUBULARS

[75] Inventors: Kenneth D. Garrett, Lubbock; Norman D. Rogers, Sundown, both of Tex.

[73] Assignee: Texaco Inc., White Plains, N.Y.

[21] Appl. No.: 357,470

[22] Filed: Dec. 16, 1994

[51] Int. Cl.[6] ..... E21B 17/00; E21B 43/00

[52] U.S. Cl. ..... 166/369; 166/68; 166/105

[58] Field of Search ..... 166/369, 380, 166/68, 105, 242

[56] References Cited

U.S. PATENT DOCUMENTS

| | | | |
|---|---|---|---|
| 3,486,557 | 12/1969 | Harrison | 166/68 |
| 4,024,913 | 5/1977 | Grable | 166/72 |
| 4,195,691 | 4/1980 | Newling | 166/68 X |
| 4,563,391 | 1/1986 | Tanner et al. | 166/68 X |
| 4,597,438 | 7/1986 | Bennett | 166/105 |

*Primary Examiner*—Hoang C. Dang

*Attorney, Agent, or Firm*—James L. Bailey; Kenneth R. Priem; William J. Beard

[57] ABSTRACT

Production from a producing oil well is increased by forming a pumping string with pipe sections of small diameter and high tensile strength at the top and large diameter low tensile strength at the bottom of the well.

2 Claims, 1 Drawing Sheet

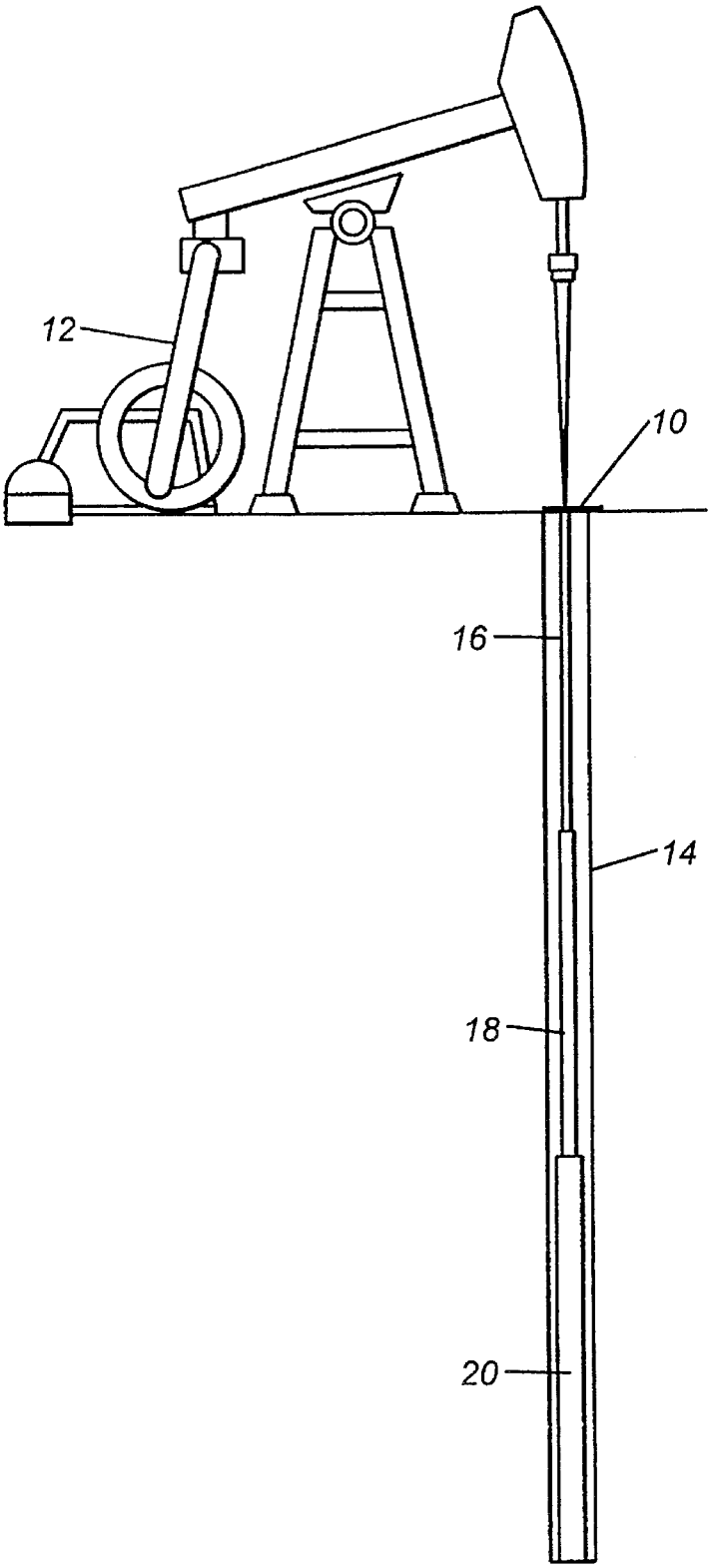
FIG.

METHOD OF ACHIEVING HIGH PRODUCTION RATES IN WELLS WITH SMALL DIAMETER TUBULARS

BACKGROUND OF THE INVENTION

The present invention relates to a method and apparatus for improving the production rate from an existing producing well.

THE PRIOR ART

Wells with high inflow performance ability that are equipped with pumping units and are completed with 3½" or 4½" casing strings are limited in daily production volumes by pumping equipment capacity, rather than the reservoir capability. These wells can only be completed with 2⅜" tubing, which limits the maximum rod diameter that can be used to ⅞". The ⅞" rods are the weak link in a production chain. Production rates of 400 BFPD are the maximum rates that can be achieved without exceeding acceptable stress loads on such rods. If a well's inflow is greater than the production equipment outflow, oil is left in the wellbore rather than being produced to the stock tank each day of operation. The solution to this problem requires a rod string which is capable of handling the high stresses that such high production volumes place on the production equipment.

SUMMARY OF THE INVENTION

The present invention achieves an increase in the production rate of a producing well by revising what has heretofore been the accepted order of rods in a string. High tensile strength small diameter rods are placed at the top of the string with progressively larger diameter lower tensile strength rods forming lower sections of the rod string.

BRIEF DESCRIPTION OF THE DRAWINGS

The present invention will now be described, by way of example, with reference to the accompanying drawings in which the single figure illustrates the present invention in a schematic vertical section through a producing well.

DETAILED DESCRIPTION OF THE INVENTION

In a typical production well produced by a rod string, an API steel rod string is assembled with the stronger (larger diameter) rods installed at the top of the string and the weaker (smaller diameter) rods at the bottom of the string in order to sustain the loads imposed by the weight of the rods, produced fluid, and pumping acceleration. This means that the largest diameter rod has been placed at the top while the smallest diameter rod has been placed at the bottom when using prior art rod string assembly techniques.

The present invention improves the production rate by assembling a rod string with smaller diameter, high tensile strength rods at the top of the string and larger diameter, lower tensile strength rods at the bottom of the string. The present invention is schematically shown in the single figure. The producing well 10 has a pumping assembly 12 and rod string 14 descending into the well. The rod string is made up of a plurality of sections 16, 18, and 20. In order to practice the present invention it is necessary that the smaller diameter rods have a much higher tensile strength than a typical prior art steel rod. Such a rod exists and is known as an EL® rod (A registered trademark of National Oilwell of Houston, Texas). EL® rods are able to withstand the high stress levels this configuration imposes on the rod system. Typical steel rods would be unable to produce a well using this configuration for a significant period of time because of the high stress loads imposed on the top rods.

It has been found, through computer simulation, that this rod string configuration results in an increase in the downhole net stroke, similar to that achieved by a fiberglass rod string. The result is a higher production rate than is possible with the typical prior art steel rod string.

The present invention was put into an actual production well application. The parameters for this producing well, prior to the installation of the rod string according to the present invention, were as follows: the well had a 4½" casing which allowed only 2⅜" tubing to be installed. 2⅜" tubing has an inner diameter of 1.995" which limited the largest diameter rod, in a typical API rod string, to ⅞". The well had sufficient reservoir pressure to be capable of producing 700 BFPD, but actual production was limited to 500 BFPD by the pumping equipment. This difference resulted in the well building up fluid within the wellbore and meant that oil, which could have been produced by reducing the fluid level, was actually stacking up within the wellbore. Attempts to increase the well's production were made in the form of speeding up the pumping unit to the maximum that the rod string would allow.

A rod string according to the present invention was installed in this well and consisted of 2,500 feet of ¾" diameter EL rods on top of 2,500 ft. of ⅞" grade D rods. This rod string was capable of achieving 645 BFPD. This was a production increase of 29% over the previous rod string. The significance of the rod string configuration of the present invention is in the newly found ability to produce wells at a higher rate, in spite of the constraints that the smaller diameter tubulars had imposed in previous designs.

The present invention may be subject to many modifications and changes without departing from the spirit or essential characteristics thereof. The present embodiment should therefore be considered in all respects as illustrative and not restrictive of the scope of the invention as defined by the appended claims.

We claim:

1. A method for improving the production rate from a producing oil well comprising the steps of:

providing the well with a rod string comprised of a plurality of rod sections, each said section being formed by metallic rods having a different diameter and tensile strength with the smallest diameter metallic rod section having the highest tensile strength;

arranging said metallic rod sections in the well with the largest diameter, lowest tensile strength metallic rods toward the bottom of the rod string and the smallest diameter, highest tensile strength metallic rods towards the top of said rod string at the top of the well.

2. In a producing oil well, a rod string comprising:

a plurality of sections of steel rod, each section having a different diameter with the tensile strength of said steel rods increasing with decreasing diameter;

said sections being joined together with the smallest diameter, highest tensile strength steel rod section at the top and the largest diameter, lowest tensile strength steel rod sections at the bottom.

* * * * *